US006711838B2

(12) United States Patent
Staub et al.

(10) Patent No.: US 6,711,838 B2
(45) Date of Patent: Mar. 30, 2004

(54) METHOD AND APPARATUS FOR DETERMINING MACHINE LOCATION

(75) Inventors: Michael David Staub, Peoria, IL (US); Claude Wesley Keefer, Elmwood, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/206,199

(22) Filed: Jul. 29, 2002

(65) Prior Publication Data

US 2004/0020083 A1 Feb. 5, 2004

(51) Int. Cl.[7] ..... E02F 5/02

(52) U.S. Cl. ..... 37/348; 701/50; 172/2; 414/699

(58) Field of Search ..... 37/348, 382, 195; 172/1, 2, 5, 6, 12; 701/50; 414/699, 694

(56) References Cited

U.S. PATENT DOCUMENTS

| | | | | | |
|---|---|---|---|---|---|
| 3,997,071 | A | | 12/1976 | Teach | |
| 4,377,043 | A | | 3/1983 | Inui et al. | |
| 4,737,705 | A | | 4/1988 | Bitar et al. | |
| 4,812,999 | A | | 3/1989 | Ohara | |
| 4,888,890 | A | * | 12/1989 | Studebaker et al. | 37/348 |
| 4,963,889 | A | | 10/1990 | Hatch | |
| 5,065,326 | A | | 11/1991 | Sahm | |
| 5,404,661 | A | | 4/1995 | Sahm et al. | |
| 5,438,771 | A | | 8/1995 | Sahm et al. | |
| 5,490,081 | A | * | 2/1996 | Kuromoto et al. | 700/178 |
| 5,625,967 | A | * | 5/1997 | Kulle | 37/443 |
| 5,699,247 | A | * | 12/1997 | Moriya et al. | 701/50 |
| 5,704,141 | A | * | 1/1998 | Miura et al. | 37/348 |
| 5,755,291 | A | | 5/1998 | Orbach et al. | |
| 5,822,891 | A | * | 10/1998 | Fujishima et al. | 37/348 |
| 5,848,485 | A | * | 12/1998 | Anderson et al. | 37/348 |
| 5,897,603 | A | | 4/1999 | Henderson | |
| 5,899,950 | A | | 5/1999 | Milender et al. | |
| 5,928,309 | A | | 7/1999 | Korver et al. | |
| 6,073,068 | A | | 6/2000 | Koehrsen | |
| 6,079,340 | A | | 6/2000 | Flamme et al. | |
| 6,081,230 | A | | 6/2000 | Hoshino et al. | |
| 6,114,993 | A | * | 9/2000 | Henderson et al. | 342/357.17 |
| 6,131,061 | A | * | 10/2000 | DenBraber et al. | 701/50 |
| 6,169,948 | B1 | * | 1/2001 | Fujishima et al. | 701/50 |
| 6,205,687 | B1 | * | 3/2001 | Rocke | 37/348 |
| 6,209,232 | B1 | * | 4/2001 | Ono et al. | 37/348 |
| 6,230,090 | B1 | * | 5/2001 | Takahashi et al. | 701/50 |
| 6,351,697 | B1 | * | 2/2002 | Baker | 701/50 |
| 6,363,632 | B1 | * | 4/2002 | Stentz et al. | 37/414 |
| 6,418,364 | B1 | * | 7/2002 | Kalafut et al. | 701/50 |
| 6,518,519 | B1 | * | 2/2003 | Crane et al. | 177/136 |
| 6,532,409 | B1 | * | 3/2003 | Fujishima et al. | 701/50 |

* cited by examiner

*Primary Examiner*—Victor Batson
(74) *Attorney, Agent, or Firm*—Finnegan, Henderson, Farabow, Garrett & Dunner

(57) ABSTRACT

A method is provided for determining the location of a work machine at a work site, where the work machine includes a house, a boom connected to the house, a stick connected to the boom, and a work implement connected to the house. Reference signals are received from an external reference source. The position of a point on the house is determined in response to the received signals. Information about the work machine is determined based on the position of the point on the house. The status of center-of-rotation (COR) information is updated. The system determines if an event has occurred. If an event is determined to have occurred, event reactions occur.

18 Claims, 15 Drawing Sheets

METHOD AND APPARATUS FOR DETERMINING MACHINE LOCATION

TECHNICAL FIELD

The invention relates generally to control of work machines and, more particularly, to a method and apparatus for determining the location and orientation of a work implement in response to an external reference.

BACKGROUND

Work machines such as excavators, backhoes, front shovels, and the like are used for excavation work. These excavating machines have work implements which consist of boom, stick and bucket linkages. The boom is pivotally attached to the excavating machine at one end, and its other end is pivotally attached to a stick. The bucket is pivotally attached to the free end of the stick. Each work implement linkage is controllably actuated by at least one hydraulic cylinder for movement in a vertical plane. An operator typically manipulates the work implement to perform a sequence of distinct functions which constitute a complete excavation work cycle.

The earthmoving industry has an increasing desire to automate the work cycle of excavating machines for several reasons. Unlike a human operator, an automated excavating machine remains consistently productive regardless of environmental conditions and prolonged work hours. The automated excavating machine is ideal for applications where conditions are dangerous, unsuitable or undesirable for humans. An automated machine also enables more accurate excavation making up for any lack of operator skill.

Much effort has gone into developing the automatic excavation algorithms. For example, the digging and therefore the bucket position may be described relative to the excavator car body or house. As long as the house sits horizontally on the ground (no tilt or pitch), the computations can be made to determine the bucket location provided that the house location is known. As the orientation of the excavator changes, additional sensors are added to determine the pitch and roll to compensate. Often a laser system is used to determine the elevation of the body and multiple detectors on the house are used to determine orientation.

Alternatively, x, y, and z location, as well as roll and pitch information, for a work machine may be determined using a single sensor. For example, see U.S. Pat. No. 5,438,771, entitled "Method and Apparatus for Determining the Location and Orientation of a Work Machine." In this method, the car body is rotated. Signals are received from an external reference source. The x, y, and z location of a receiver is determined as the car body rotates, based on the location of the receiver at a plurality of points during the rotation. From this information, the location and orientation of the car body can be determined.

The above method requires that at least three location points be obtained. The first point is measured at the start of a reversal of swing. The second point is measured at a valid point a certain distance from the first point. The third point is measured at the endpoint of an arc, signaled by another reversal of swing. Most importantly, however, the method requires that the machine does not tram (or move) and rotate at the same time. In this situation, the location and orientation information determined by the processor is invalidated.

This invalidation presents a problem for mining operations. When this happens, the system may be unable to determine the material composition of the bucket load. In a typical mining situation, this may result in up to 20% of bucket loads being unidentified. This may result in sending ore to a waste site and/or sending waste to an ore processing site. Further, this situation limits the ability to automate an excavation process.

The present invention is directed to overcoming one or more of the problems or disadvantages associated with the prior art.

SUMMARY OF THE INVENTION

A method is provided for determining the location of a work machine at a work site, where the work machine includes a house, a boom connected to the house, a stick connected to the boom, and a work implement connected to the stick. Reference signals are received from an external reference source. The position of a point on the house is determined in response to the received signals. Information about the work machine is determined based on the position of a point on the house. The status of center-of-rotation (COR) information is updated. The system determines if an event has occurred. If an event is determined to have occurred, event reactions occur.

An apparatus is provided for determining the location of a work machine at a work site. The apparatus comprises a house, a boom connected to the house, a stick connected to the boom, and a work implement connected to the stick. The apparatus further includes a positioning system including a receiver connected to the house. The positioning system is configured to determine the location of the receiver in three dimensional space at a plurality of points as the house is rotated and further to determine the location and orientation of the work implement in response to the location of the plurality of points. The apparatus also includes a sensor configured to identify an event and a processor configured to determine the location of the receiver in three dimensional space at the time of an event and to process the event in relation to the location of the receiver and the location of the plurality of points.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate an exemplary embodiment of the invention and together with the description, serve to explain the principles of the invention.

In the drawings.

DETAILED DESCRIPTION

Reference will now be made in detail to embodiments of the invention, examples of which are illustrated in the accompanying drawings. Wherever possible, the same reference numbers will be used throughout the drawings to refer to the same or like parts.

Figure 1:
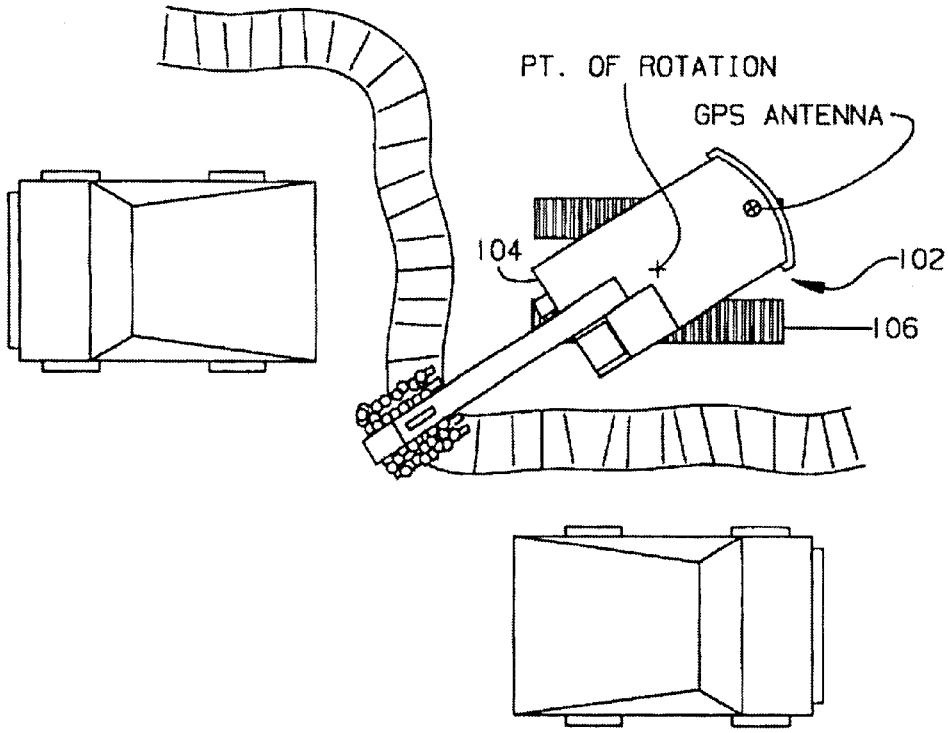
FIG. 1 is a diagrammatic illustration of a hydraulic excavator operating in a work site.
Figure 2:
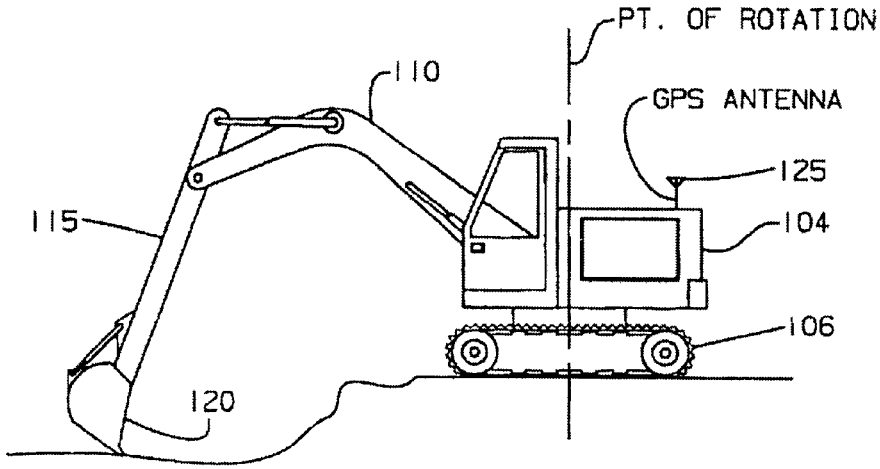
FIG. 2 is a diagrammatic illustration of a hydraulic excavator operating in a work site.
Figure 3:
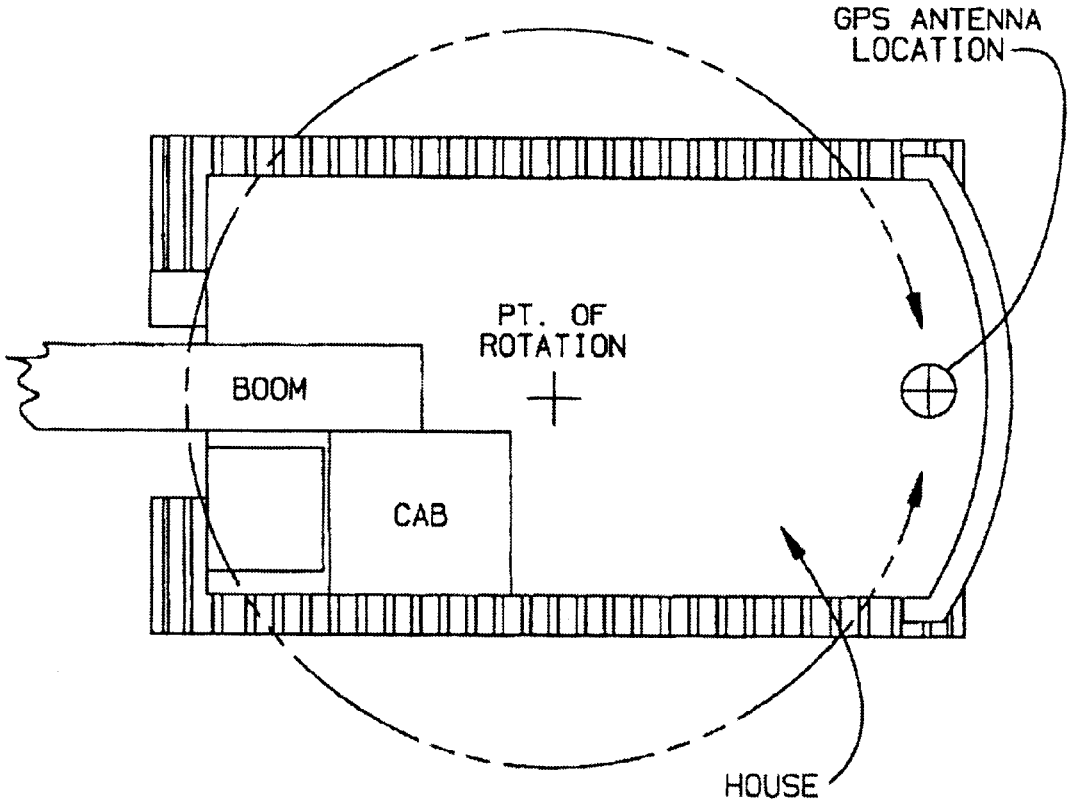
FIG. 3 is a schematic top view of a hydraulic excavator.

A work machine is illustrated in FIGS. 1, 2, and 3 and may include an excavator, power shovel, or the like. The work machine 102 includes a rotatable house 104 connected to an undercarriage 106. The work machine 102 may also include a boom 110, stick 115, and bucket 120. The boom 110 is pivotally mounted on the excavating machine house 104 by a boom pivot pin. The stick 115 is pivotally connected to the free end of the boom 110 at a stick pivot pin. The bucket 120 is pivotally attached to the stick 115 at a bucket pivot pin.

As shown in FIGS. 2 and 3, a receiver 125 is connected to the house 104. The receiver is advantageously displaced from and rotates about the axis of rotation of the house 104 as the house 104 swings with respect to the undercarriage 106. In the preferred embodiment, the receiver 125 is part of a known three-dimensional positioning system with an external reference, for example (but not limited to) 3-D laser, GPS, GPS/laser combinations, radio triangulation, microwave, or radar. While the receiver 125 is shown mounted to the rear of the house 104 opposite the implement linkage, it should be apparent that other locations are equally possible, such as on top of the operator compartment.

Figure 4:
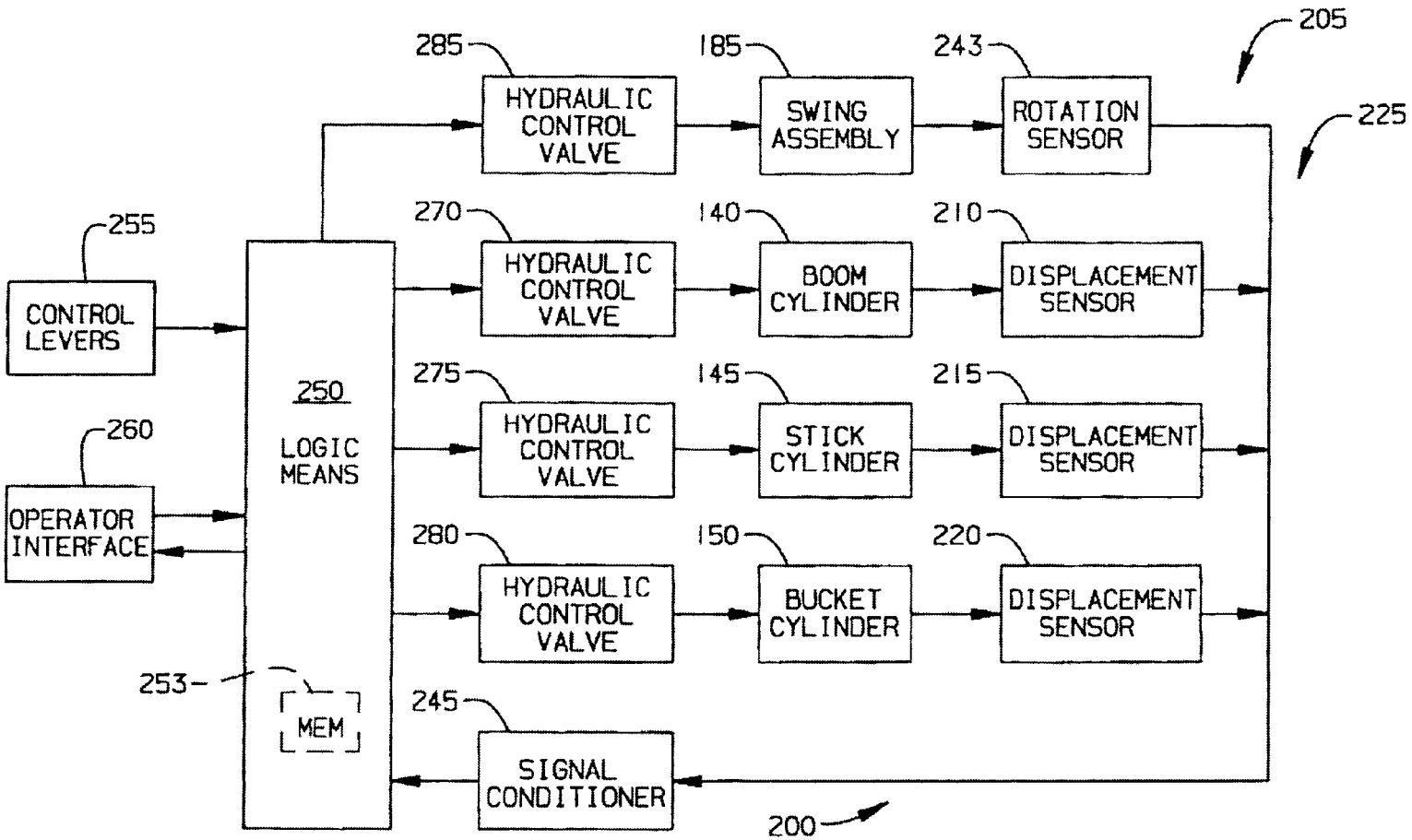
FIG. 4 is a block diagram of a machine control.

Referring now to FIG. 4, a block diagram of an electro-hydraulic system 200 associated with the work machine 102 is shown. A means 205 produces position signals in response to the position of a work implement, or bucket 120. The means 205 includes displacement sensors 210, 215, 220 that sense the amount of cylinder extension in the boom, stick and bucket hydraulic cylinders 140, 145, 150, respectively. A radio frequency based sensor described in U.S. Pat. No. 4,737,705 issued to Bitar et al. on Apr. 12, 1988 may be used. The bucket position is also derivable from the work implement joint angle measurements. An alternative device for producing a work implement position signal includes rotational angle sensors such as rotatory potentiometers, for example, which measure the angles between the boom 110, stick 115 and bucket 120. The work implement position may be computed from either the hydraulic cylinder extension measurements or the joint angle measurement by trigonometric methods. Such techniques for determining bucket position are well known in the art and may be found in, for example, U.S. Pat. No. 3,997,071 issued to Teach on Dec. 14, 1976 and U.S. Pat. No. 4,377,043 issued to Inui et al. on Mar. 22, 1983.

A swing angle sensor 243, such as a rotary potentiometer, located at the work implement pivot point, produces an angle measurement corresponding to the amount of work implement rotation about the swing axis.

The position signals are delivered to a signal conditioner 245. The signal conditioner 245 provides conventional signal excitation and filtering. A Vishay Signal Conditioning Amplifier 2300 System manufactured by Measurements Group, Inc. of Raleigh, N.C. may be used for such purposes, for example. The conditioned position signals are delivered to a logic means 250, which may include memory 253. The logic means 250 is a microprocessor based system which utilizes arithmetic units to control processes according to software programs. Typically, the programs are stored in read-only memory, random-access memory or the like. The programs are discussed in relation to various flowcharts described below.

The logic means 250 includes inputs from two other sources: multiple joystick control levers 255 and an operator interface 260. The control lever 255 provides for manual control of the work implement. The output of the control lever 255 determines the bucket movement direction and velocity.

The interface 260 device may include a liquid crystal display screen with an alphanumeric key pad. A touch sensitive screen implementation is also suitable. Further, the operator interface 260 may also include a plurality of dials and/or switches for the operator to make various excavating condition settings.

Figure 5:
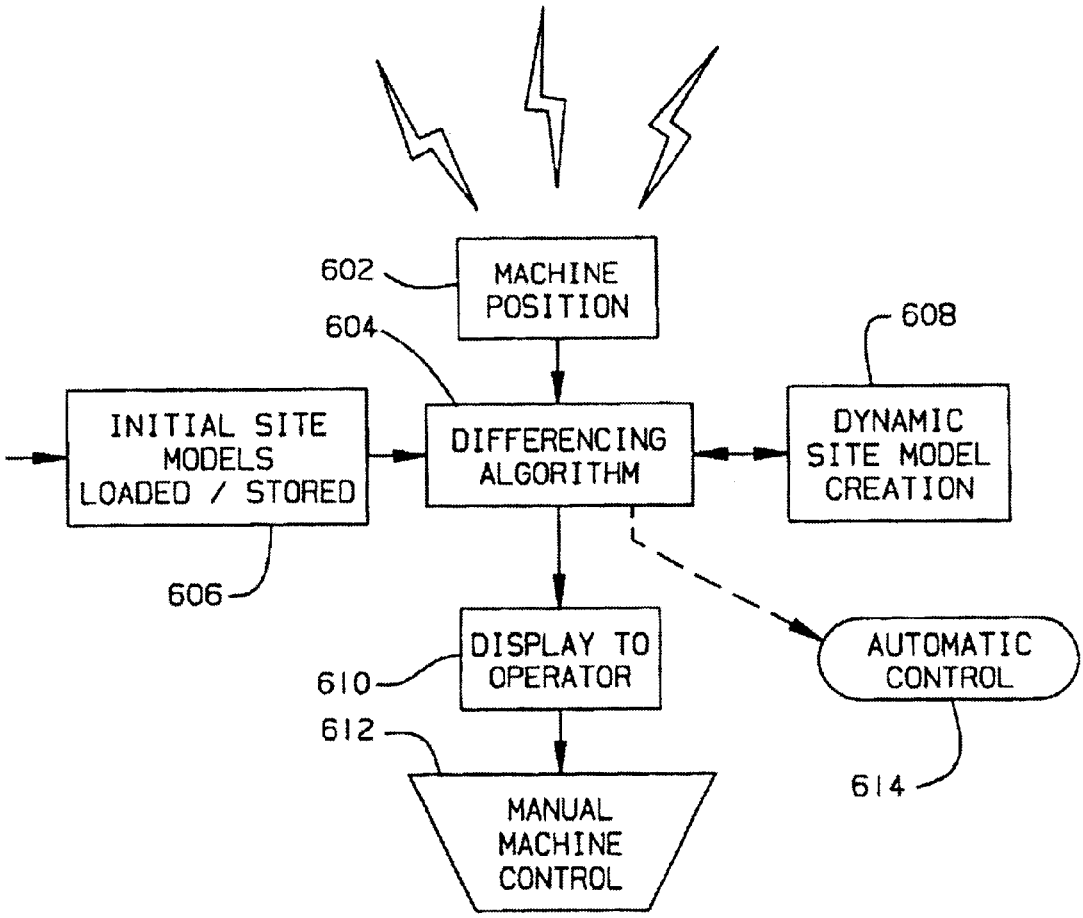
FIG. 5 is a block diagram describing the interrelated system.

Turning now to FIG. 5, the method of the present invention is shown schematically. Using a known three-dimensional positioning system with an external reference, for example (but not limited to) 3-D laser, GPS, GPS/laser combinations, radio triangulation, microwave, or radar, receiver position coordinates are determined in block 602 as the machine operates within the work site. These coordinates are instantaneously supplied as a series of discrete points to a differencing algorithm at 604. The location and orientation information is then made available to the operator in display step 610, providing real time position indications of the work machine 102 in a presurveyed work site in human readable form. Using the information from the display the operator can efficiently monitor and direct the manual control of the machine at 612.

Additionally, or alternately, the dynamic update information can be provided to an automatic machine control system at 614. The controls can provide an operator assist to minimize machine work and limit the manual controls if the operator's proposed action would, for example, overload the machine. Alternately, the site update information from the dynamic database can be used to provide fully automatic machine/tool control.

Figure 6:
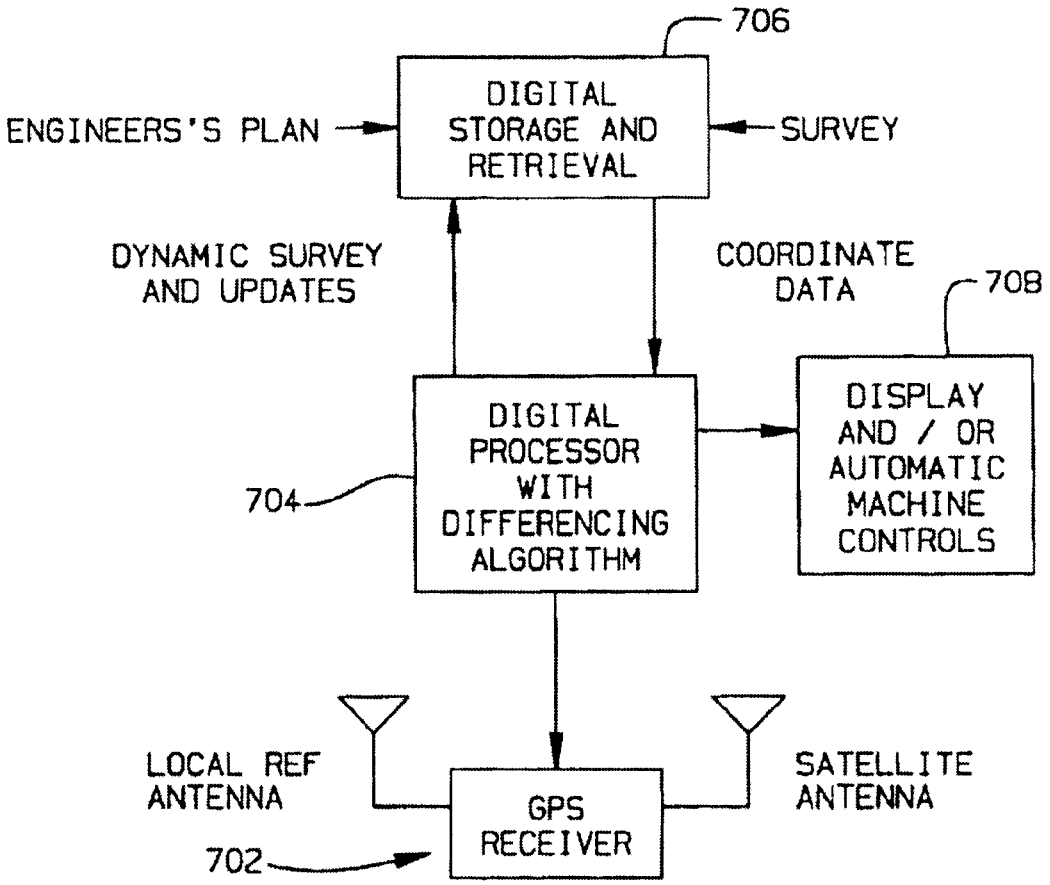
FIG. 6 is a block diagram describing the interrelated system.

Referring now to FIG. 6, an apparatus which can be used in connection with the receipt and processing of GPS signals to carry out the present invention is shown in block diagram form comprising a GPS receiver apparatus 702 with a local reference antenna and a satellite antenna; a digital processor 704 employing a differencing algorithm, and connected to receive position signals from 702; a digital storage and retrieval facility 706 accessed and updated by processor 704, and an operator display and/or automatic machine controls at 708 receiving signals from processor 704.

GPS receiver system 702 includes a satellite antenna receiving signals from global positioning satellites, and a local reference antenna. The GPS receiver system 702 uses position signals from the satellite antenna and differential correction signals from the local reference antenna to generate position coordinate data in three-dimensions to centimeter accuracy for moving objects. Alternatively, raw data from the reference antenna can be processed by the system to determine the position coordinate data.

This position information is supplied to digital processor 704 on a real-time basis as the coordinate sampling rate of the GPS receiver 702 permits. The digital storage facility 706 stores a site model of the work site. The machine position and site model are provided to the operator display and/or automatic machine controls at 708 to direct the operation of the machine over the site.

Figure 7:
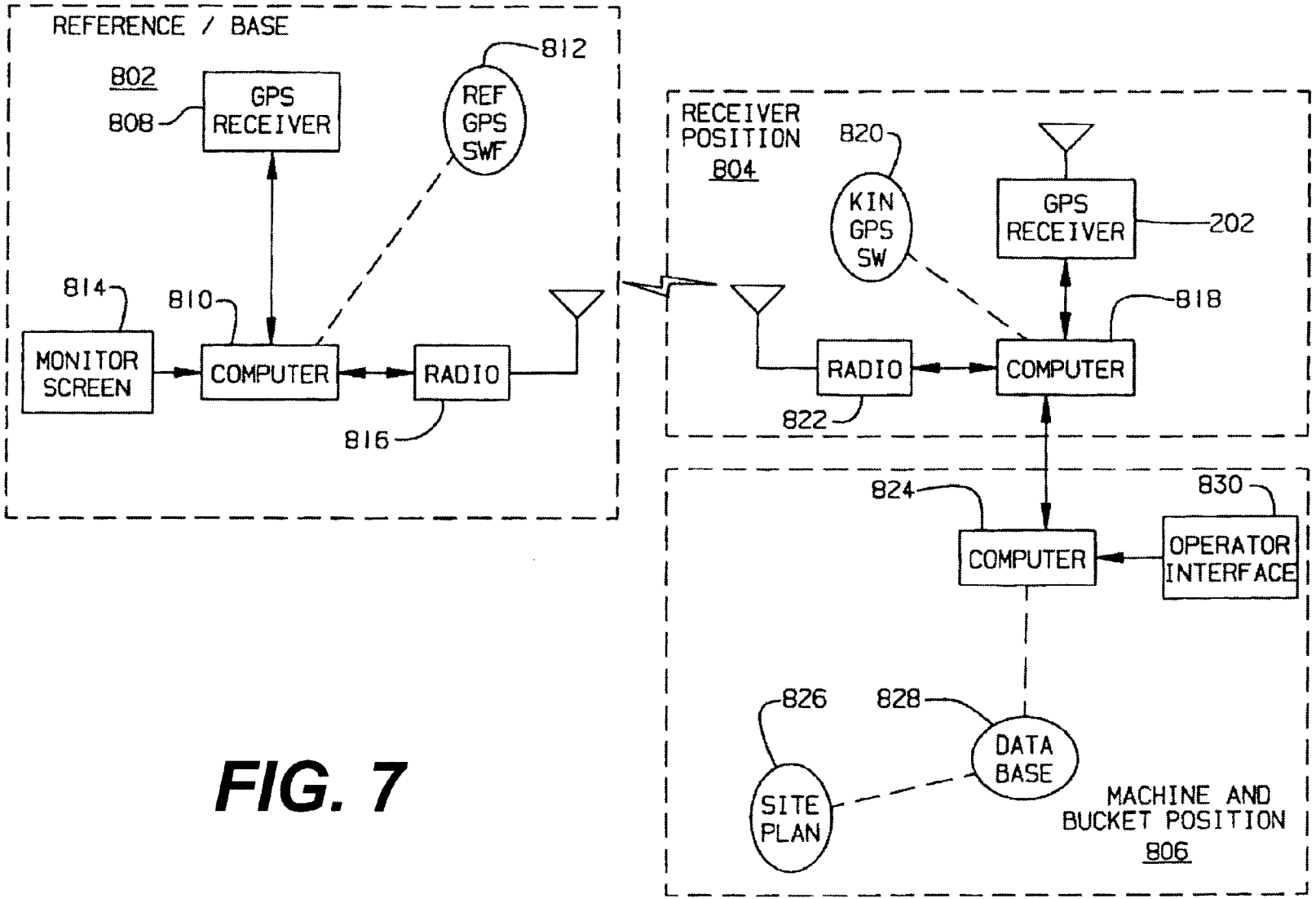
FIG. 7 is a block diagram describing the interrelated system.

Referring now to FIG. 7, a more detailed schematic of a system according to FIG. 6 is shown using kinematic GPS for position reference signals. A base reference module 802 and a position module 804 together determine the three-dimensional coordinates of the receiver 125 relative to the site, while an machine and bucket position module 806 converts this position information into real time representations of the machine, bucket, and work site which can be used to accurately monitor and control the machine.

Base reference module 802 includes a stationary GPS receiver 808; a computer 810 receiving input from receiver 808; reference receiver GPS software 812, temporarily or permanently stored in the computer 810; a standard computer monitor screen 814; and a digital transceiver-type radio 816 connected to the computer and capable of transmitting a digital data stream. In the illustrative embodiment base reference receiver 808 is a high accuracy kinematic GPS receiver; computer 810 for example is a computer with a hard drive, RAM, serial communication ports, a printer port, an external monitor port, and an external keyboard port; monitor screen 814 is a passive matrix color LCD or any other suitable display type; and radio 816 is a commercially available digital data transceiver.

Position module 804 comprises a matching kinematic GPS receiver 202, a matching computer 818 receiving input from receiver 202, kinematic GPS software 820 stored permanently or temporarily in computer 818, and a matching transceiver-type digital radio 822 which receives signals from radio 816 in base reference module 802. In the illustrative embodiment, position module 804 is located on the mining shovel to move with it over the work site.

Machine and bucket machine and bucket position module 806, also carried on board the machine in the illustrated embodiment, includes an additional logic means 250, receiving input from position module 804; one or more digitized site models 826 digitally stored or loaded into the computer memory; a dynamic database update module 828, also stored or loaded into the memory of logic means 250; and an operator interface 260 including a color display screen connected to the logic means 250. Instead of, or in addition to, operator interface 260, an automatic machine controls can be connected to the computer to receive signals which operate the machine in an autonomous or semi-autonomous manner. To provide further information regarding operation of the work machine 102 to the logic means 250, the sensors and inputs illustrated in FIG. 4 are also connected to the logic means 250.

Although machine and bucket position module 806 is here shown mounted on the mobile machine, some or all portions may be stationed remotely. For example, logic means 250, site model(s) 826, and dynamic database 828 could be connected by radio data link to position module 804 and operator interface 260. Position and site update information can then be broadcast to and from the machine for display or use by operators or supervisors both on and off the machine.

Base reference station 802 is fixed at a point of known three-dimensional coordinates relative to the work site. Through receiver 808 base reference station 802 receives position information from a GPS satellite constellation, using the reference GPS software 812 to derive an instantaneous error quantity or correction factor in known manner. This correction factor is broadcast from base station 802 to position station 804 on the mobile machine via radio link 816,822. Alternatively, raw position data can be transmitted from base station 802 to position station 804 via radio link 816,822, and processed by computer 818.

Machine-mounted receiver 125 receives position information from the satellite constellation, while the kinematic GPS software 820 combines the signal from receiver 125 and the correction factor from base reference 802 to determine the position of receiver 125 relative to base reference 802 and the work site within a few centimeters. This position information is three-dimensional (e.g., latitude, longitude, and elevation; easting, nording, and up; or the like) and is available on a point-by-point basis according to the sampling rate of the GPS system.

Referring to machine and bucket position module 806, once the digitized plans or models of the site have been loaded into logic means 250, the position information received from position module 804 is used by the logic means 250 together with the database 828 to generate a graphic icon of the machine superimposed on the actual site model on operator interface 260 corresponding to the actual position and orientation of the machine on the site.

Because the sampling rate of the position module 804 results in a time/distance delay between position coordinate points as the machine operates, the dynamic database 828 of the present invention uses a differencing algorithm to determine and update in real-time the path of the receiver 125.

With the knowledge of the machine's exact position relative to the site, a digitized view of the site, and the machine's progress relative thereto, the operator can maneuver the bucket to excavate material without having to rely on physical markers placed over the surface of the site. And, as the operator operates the machine within the work site the dynamic database 828 continues to read and manipulate incoming position information from module 804 to dynamically update both the machine's position relative to the site and the position and orientation of the bucket.

The work machine 102 is equipped with a positioning system capable of determining the position of the machine with a high degree of accuracy, in the preferred embodiment a phase differential GPS receiver 125 located on the machine at fixed, known coordinates relative to the house 104. Machine-mounted receiver 125 receives position signals from a GPS constellation and an error/correction signal from base reference 808 via radio link 816,822 as described in FIG. 7. The system uses both the satellite signals and the error/correction signal from base reference 808 to accurately determine its position in three-dimensional space. Alternatively, raw position data can be transmitted from base reference 802, and processed in known fashion by the machine-mounted receiver system to achieve the same result. Information on kinematic GPS and a system suitable for use with the present invention can be found, for example, in U.S. Pat. No. 4,812,991 dated Mar. 14, 1989 and U.S. Pat. No. 4,963,889 dated Oct. 16, 1990, both to Hatch. Using kinematic GPS or other suitable three-dimensional position signals from an external reference, the location of receiver 125 can be accurately determined on a point-by-point basis within a few centimeters as the work machine 102 operates within the work site. The present sampling rate for coordinate points using the illustrative positioning system is approximately one point per second.

The coordinates of base receiver 808 can be determined in any known fashion, such as GPS positioning or conventional surveying. Steps are also being taken in this and other countries to place GPS references at fixed, nationally surveyed sites such as airports. If the reference station is within range (currently approximately 20 miles) of such a nationally surveyed site and local GPS receiver, that local receiver can be used as a base reference. Optionally, a portable receiver such as 808, having a tripod-mounted GPS receiver, and a rebroadcast transmitter can be used. The portable receiver 808 is surveyed in place at or near the work site.

In a preferred embodiment, the work site has previously been surveyed to provide a detailed topographic design. The creation of geographic or topographic designs of sites such as landfills, mines, and construction sites with optical surveying and other techniques is a well-known art; reference points are plotted on a grid over the site, and then connected or filled in to produce the site contours on the design. The greater the number of reference points taken, the greater the detail of the map.

Systems and software are currently available to produce digitized, three-dimensional maps of a geographic site. For example, a site plan can be converted into three-dimensional digitized models of the original site geography or topography. The site contours can be overlaid with a reference grid of uniform grid elements in known fashion. The digitized site plans can be superimposed, viewed in two or three dimensions from various angles (e.g., profile and plan), and color coded to designate areas in which the site needs to be excavated. Available software can also make cost estimates and identify various site features and obstacles above or below ground.

Once location and orientation of the work machine within the work site are obtained by the logic means 250, this data can be used by a known automatic excavation system to control excavation with respect to the work site rather than with respect to the work machine itself. An example of an automatic excavation system useful in connection with the present invention is disclosed in U.S. Pat. No. 5,065,326 issued Nov. 12, 1991 to Sahm.

The linkage position sensors illustrated above in FIG. 4 are utilized by the known methods to indicate the location of the bucket with respect to the center of rotation of the excavator. By combining bucket location and orientation in the machine reference frame with the machine location and orientation in an external reference frame, obtained by the algorithm described below, the bucket location and orientation can be offset by using known geometric translations to establish bucket location and orientation within the external reference frame. Thus, the position of the bucket with respect to the work site is monitored and controlled.

Figure 8:
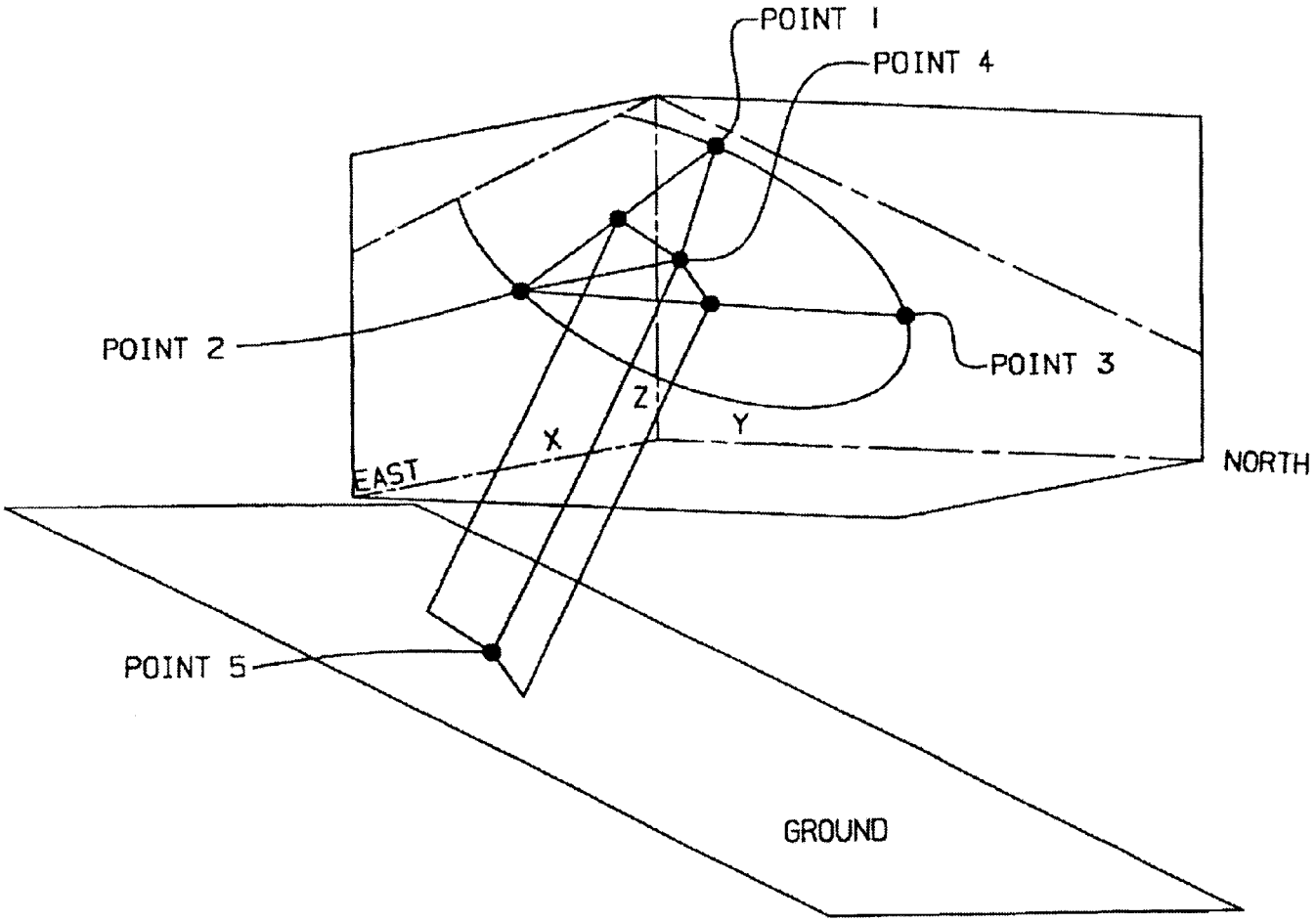
FIG. 8 illustrates the geometry on which portions of the system is based.
Figure 9A:
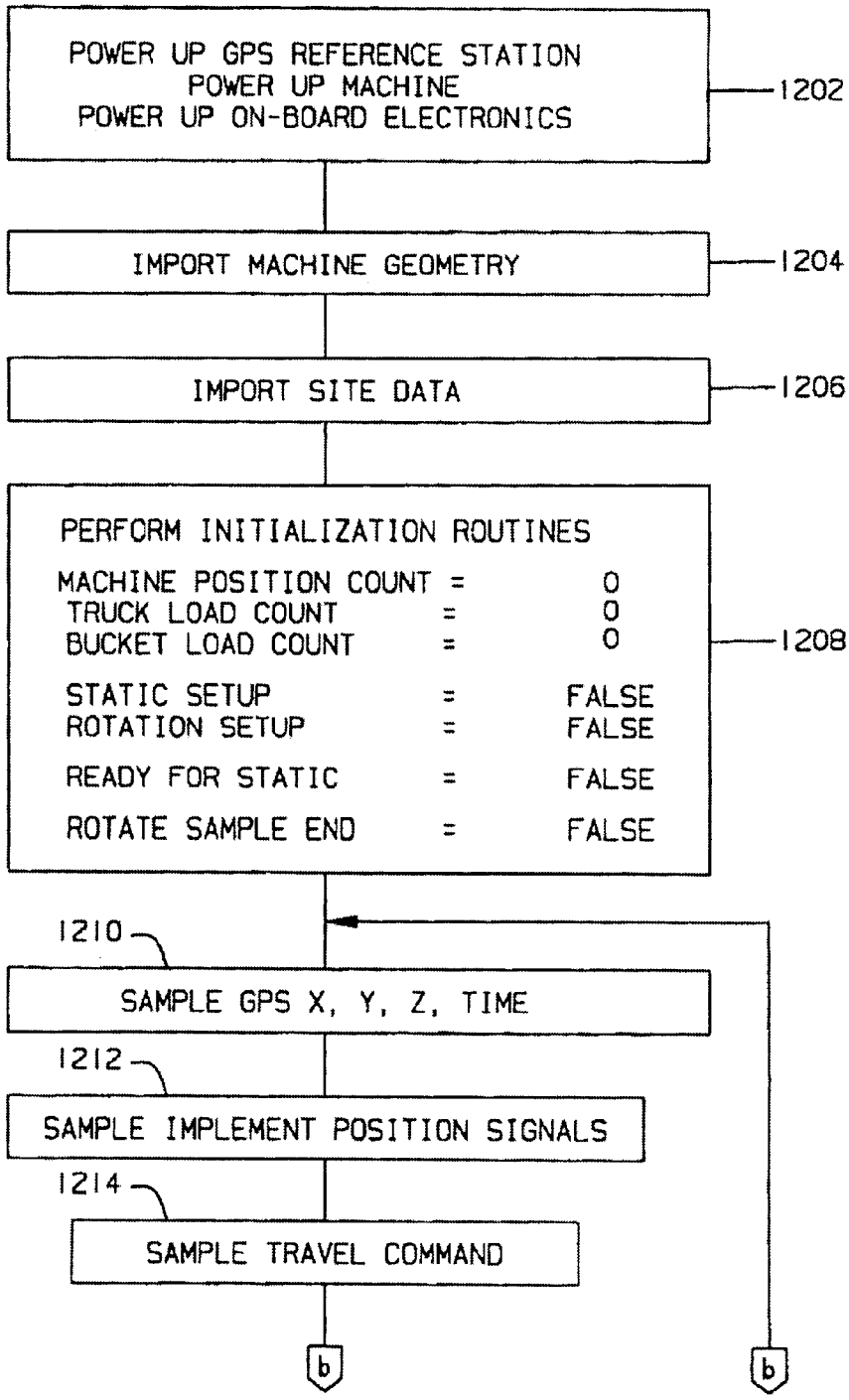
FIGS. 9*a* through 9*e* illustrate a flow chart of an algorithm used in an embodiment of the invention.
Figure 9B:
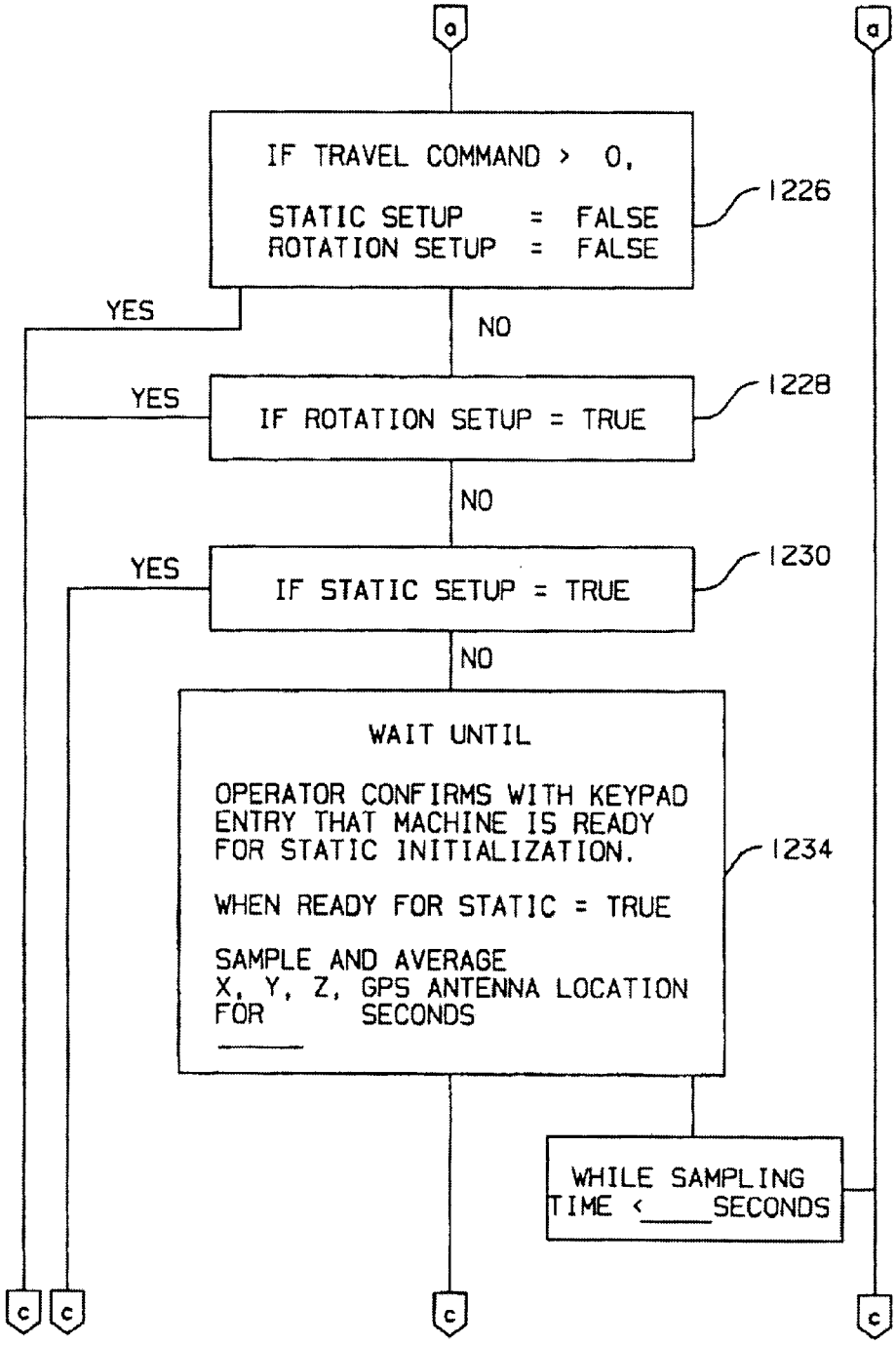
Figure 9C:
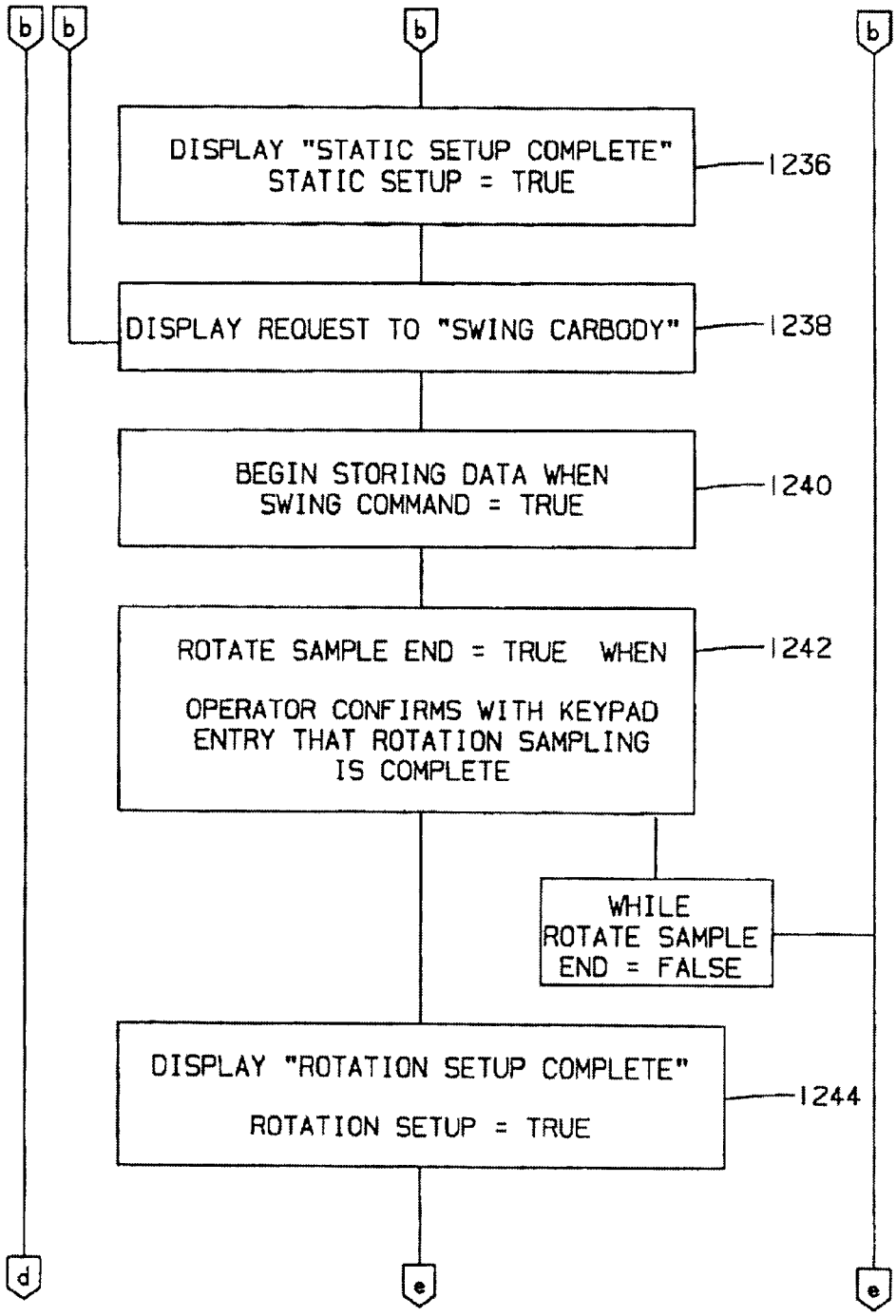
Figure 9D:
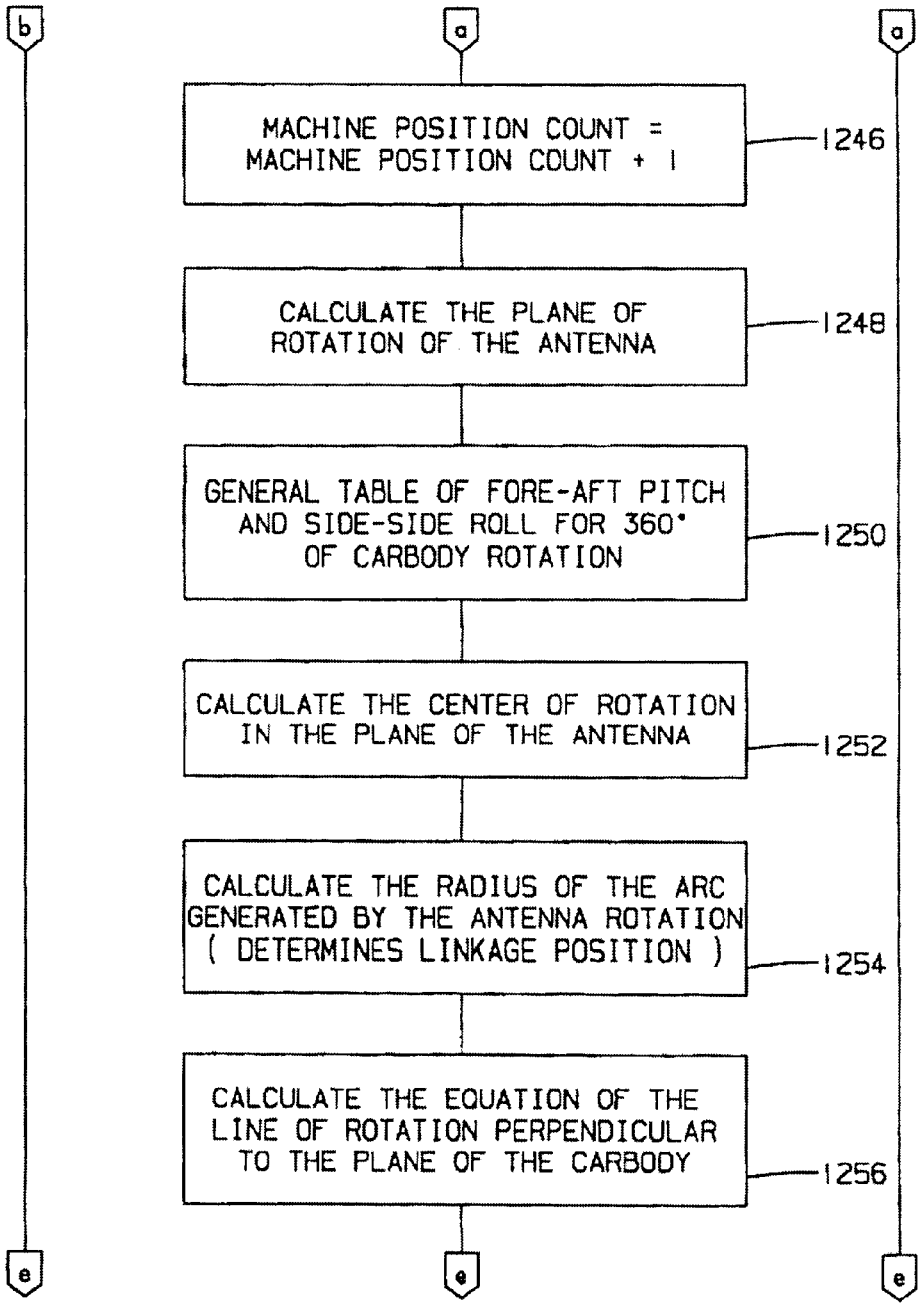
Figure 9E:
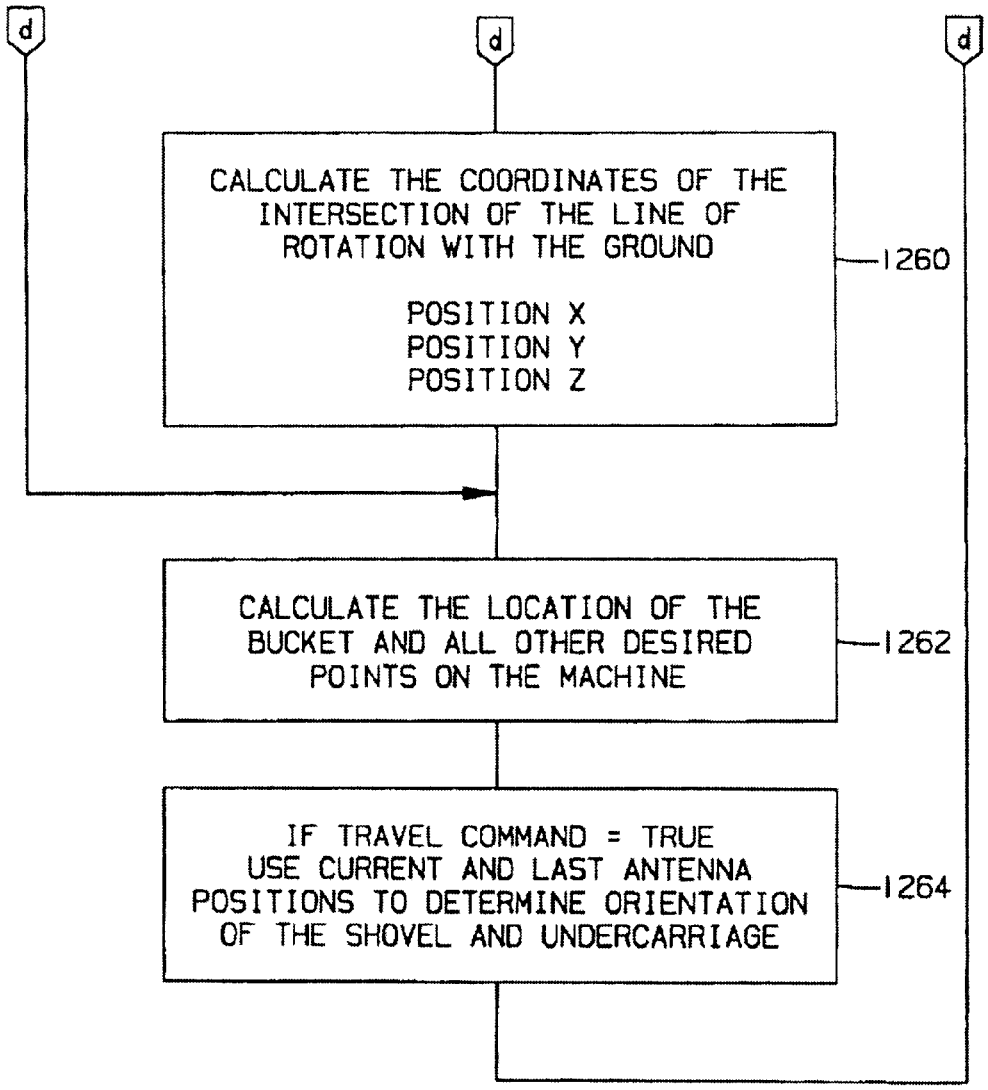

Turning now to the illustration of FIG. 8, the calculation of the location and orientation of the house 104 and the location of the bucket 120 which is performed by the logic means 250 is described. As described below, roll and pitch of an excavator refers to the side-side and fore-aft slope. Since an excavator rotates, roll and pitch continually varies from the operator's perspective in many operating environments. Therefore, the equation of the plane upon which the house 104 rotates is calculated, and from this equation, the slope, or roll and pitch, can be displayed using whatever frame of reference is desired. The two most common frames of reference would be to display the surface using perpendicular axes determined by N-S and E-W, or along and transverse to the machines fore-aft axis.

The calculations listed below determine the equation of a plane from the x, y, and z coordinates of 3 points sampled by the receiver 125. For ease of understanding, arbitrary values were selected to provide sample calculations; however, none of the values used should in any way limit the generality of the invention and these formulae.

A. To calculate the Plane of Rotation Through 3 Sampled Points:

| | |
|---|---|
| pt1 = (pt1x, pt1y, pt1z) | (1, 1, 3) PNT1 |
| pt2 = (pt2x, pt2y, pt2z) | (7, 2, 2) PNT2 |
| pt3 = (pt3x, pt3y, pt3z) | (2, 5, 1) PNT3 |
| pt1x*A + pt1y*B + pt1z*C + D = 0 | |
| Pt2x*A + pt2y*B + pt2z*c + D = 0 | |
| Pt3x*A + pt3y*B + pt3z*c + D = 0 | |

By solving the above formulae, the following solution is obtained:

$$-0.02439*pt_x-0.13414*pt_y-0.28049*pt_z+1=0$$

For a simple example, assume an operator is facing North (positive y direction in this example). The side-side roll is calculated by picking any two x values on a plane perpendicular to the direction and calculating the z values.

For x=0, y=0, z=3.56519 x=7, y=0, z=2.9565

Side-Side roll=(2.9565−3.56519)/(7−0)=0.08696 with West higher than East=4.96 degrees Similarly, the fore-aft pitch can be calculated;

For x=7, y=0, z=3.56519 x=7, y=5, z=1.17402

Fore-aft pitch=((1.17402−3.56519)/(5)=0.47823 with South higher than North=25.56 degrees In a preferred embodiment, the center of rotation of the arc described by the rotation of the antenna and 3 sampled points is determined by locating the intersection of 3 planes. One plane is determined by the rotation of the antenna. A second plane is perpendicular to and extending through the midpoint of a line connecting pt1 and pt2. A third plane is perpendicular to and extending through the midpoint of a line connecting pt2 to pt3. Sample calculations to determine the center of rotation of the receiver rotation are listed below.

B. Calculate the Plane Perpendicular to Line From pt1 and pt2

Through the Midpoint

| | |
|---|---|
| pt1 = (pt1x, pt1y, pt1z) | (1, 1, 3) |
| pt2 = (pt2x, pt2y, pt2z) | (7, 2, 2) |

$$midpt_1_2=((pt1x+pt2x)/2,(pt1y+pt2y)/2,(pt1z+pt2z)/2)$$

$$midpt_1_2=(4,1.5,2.5)$$

$$dir_num_x=pt2x-pt1x=6$$

$$dir_num_y=pt2y-pt1y=1$$

$$dir_num\text{-}z=pt2z-pt1z=1$$

where dir_num_x, dir_num_y, and dir_num_z refer to the direction number in x, y, and z, respectively.

$$0=dir_num_x*(X\text{-}midpt_1_2_x)+dir_num_y*(Y\text{-}midpt_1_2_y)+dir_num_z*(Z\text{-}midpt_1_2_z)$$

where midpt_1_2_x, midpt_1_2_y, and midpt_1_2_z refer to the x, y, and z coordinates, respectively, of the midpoint of the line connecting pt1 and pt2.

Solving for the equation of the plane provides:

$$0=6pt_x+pt_y-pt_z-23$$

Similarly, calculate the Plane Perpendicular to Line From pt2 and pt3 Through the Midpoint.

| | |
|---|---|
| pt2 = (pt2x, pt2y, pt2z) | (7, 2, 2) |
| pt3 = (pt3x, pt3y, pt3z) | (2, 5, 1) |

$$midpt_\mathbf{2}_\mathbf{3}=((pt\mathbf{2}x+pt\mathbf{3}x)/2,(pt\mathbf{2}y+pt\mathbf{3}y)/2,(pt\mathbf{2}z+pt\mathbf{3}z)/2)$$

$$midpt_\mathbf{2}_\mathbf{3}=(4.5,3.5,1.5)$$

$$dir_num_x=pt\mathbf{3}x-pt\mathbf{2}x=-5$$

$$dir_num_y=pt\mathbf{3}y-pt\mathbf{2}y=3$$

$$dir_num\text{-}z=pt\mathbf{3}z-pt\mathbf{2}z=-1$$

$$0=dir_num_x*(X\text{-}midpt_\mathbf{2}_\mathbf{3}_x)+dir_num_y*(Y\text{-}midpt_\mathbf{2}_\mathbf{3}_y)+dir_num_z*(Z\text{-}midpt_\mathbf{2}_\mathbf{3}_z)$$

$$0=-5pt_x+3pt_y-pt_z+13.5$$

C. Calculate Point of Intersection Between Plane of Rotation, Plane Perpendicular to Midpoint Pt1_2, and Plane Perpendicular to Midpoint Pt2_3

$$-0.02439*pt_x-0.13414*pt_y-0.28049*pt_z+1=0=\text{Plane of Rotation}$$

$$6pt_x+pt_y-pt_z-23=0=\text{Plane Perp to Midpt Pt}\mathbf{1}_\mathbf{2}$$

$$-5pt_x+3pt_y-pt_z+13.5=0=\text{Plane Perp to Midpt Pt}\mathbf{2}_{3}$$

$$23pt_y-11pt_z-34=0=\text{Intersection of the 2 Planes through Midpoints}$$

D. To calculate the point of the center of rotation (COR) of the receiver:

$$-0.02439*pt_x-0.13414*pt_y-0.28049*pt_z+1=0$$

$$6pt_x+pt_y-pt_z-23=0$$

$$pt_y=-2.1876pt_z+6.96909$$

$$pt_z_ant_rot_center=2.05968$$

$$pt_y_ant_rot_center=(11pt_z+34)/23=2.46333$$

$$pt_x_ant_rot_center=(-pt_y+pt_z+23)/6=3.76606$$

Once the COR is known, the distance to any of the previously sampled three points is the radius of the antenna rotation. Since the receiver 125 is fixed with respect to the house 104, its radius of rotation and height above the ground are known. The intersection of the line of carbody rotation and the ground can be calculated as shown below. This point is important because the z coordinate indicates the elevation of the ground directly beneath the machine.

The equation of a line perpendicular to the plane through the center of antenna rotation as derived above is:

$$-0.02439*pt_x-0.13414*pt_y-0.28049*pt_z+1=0$$

$$pt_x_ant_rot_center=3.76606$$

$$pt_y_ant_rot_center=2.46333$$

$$pt_z_ant_rot_center=2.05968$$

$$pt_x_gnd_rot_center=3.76606-0.02439t$$

$$pt_y_gnd_rot_center=2.46333-0.13414t$$

$$pt_z_gnd_rot_center=2.05968-0.28049t$$

$$\text{assume height}=5=((-0.02439t)\hat{}2+(0.13414t)\hat{}2+(0.28049t)\hat{}2)\hat{}0.55=0.31187t;\ t=16.03231$$

$$pt_x_gnd_rot_center=3.76606-0.02439t=3.37503$$

$$pt_y_gnd_rot_center=2.46333-0.13414t=0.31276$$

$$pt_z_gnd_rot_center=2.05968-0.28049t=2.43722$$

Where pt_x_gnd_rot_center, pt_y_gnd_rot_center, and pt_z_gnd_rot_center are the coordinates in x, y, and z, respectively, of the intersection of the axis of rotation with the ground.

Now, enough information is known to display the work machine relative to the surroundings. With a known location and orientation of the work machine in the external reference frame, the location of the bucket in the external reference frame is obtained by using known geometric translations between the external reference frame and the location of the bucket in the machine reference frame, obtained from the sensor signals described in connection with FIG. 4.

A flow chart of an algorithm to be executed by the logic means 250 in one embodiment of the invention is illustrated in FIGS. 9*a*–9*e*. The GPS reference station 802, the work machine 102, and the on-board electronics are powered up at block 1202. The machine geometry and site data are uploaded to the logic means 250 from the data base 828 in blocks 1204 and 1206, respectively. The variables and flags listed in block 1208 are initialized. The GPS position of the receiver 125 is sampled and time stamped at block 1210.

The implement control signals are sampled at block 1212. The travel command is sampled at block 1214 by determining whether the control lever 255 associated with travel has been actuated. If travel command is "true" at block 1226 thus indicating that the undercarriage is moving, then the static_setup and rotation_setup flags are set equal to "false" and control passes to block 1262. Similarly if rotation_setup is true at block 1228 thus indicating that the rotation setup at that location has been completed, control passes to block 1262. If static_setup is true at block 1230 thus indicating that the static_setup has been completed, then control passes to block 1238.

The operator then uses a keypad included in the operator interface to indicate that the machine is ready for static initialization. When the ready_for_static flag is therefore set equal to "true", the receiver 125 location is sampled and averaged for a predetermined length of time. The phrase "static setup complete" is then displayed on the operator interface 260 and the static_setup flag is set equal to "true" at block 1236.

It should be noted that the static setup routine described in connection with blocks 1230, 1234, and 1236 is included for generality only and represents only one embodiment. The algorithm of FIG. 9 is operable without static setup in which case the first point would be automatically sampled in response to the travel command being substantially equal to zero at block 1226 and the algorithm would proceed to block 1238 to begin rotation setup.

At block 1238, the operator interface 260 displays the message "swing car body". When swing_command is "true" in response to the swing sensor 243 indicating that the car body or house is swinging, receiver locations derived by the kinematic GPS system are stored at regular intervals until the operator indicates via the keypad that rotation sampling is complete at block 1242. However, the operator is prevented from terminating rotation setup until three points have been obtained. The operator interface 260 then indicates that "rotation setup is complete" and the rotation_setup flag is set equal to "true". The machine_position_count is incremented at block 1246.

The plane of rotation of the receiver 125 is calculated in block 1248 as described above in connection with FIG. 8. The logic means 250 then calculates at block 1250 the fore-aft pitch and side-side roll of the car body for each of the 360 degrees of rotation to save processing time during operation of the mining shovel. More precision of course can be achieved by increasing the number of calculations.

At block 1252, the center of rotation of the plane of receiver rotation is calculated as described above in connection with FIG. 10. The equation of the line of rotation perpendicular to the plane of the car body is calculated at block 1256. The coordinates of the intersection of the line of rotation with the ground is determined at block 1260. At block 1262, the location of the bucket 108 is determined in response to the location of the receiver 125, the above calculated values, and the signals from the sensors shown in FIG. 4.

If travel command is true at block 1264, then the current and last receiver positions are used to calculate the location of the work machine 102. In the preferred embodiment, it is assumed that travel occurs only when front of the house 104 is facing in the direction of undercarriage travel. This assumption allows ease of tracking of the machine during travel.

Alternatively, the position of the work machine is only calculated, and the machine displayed in the work site, in response to the sampled points fitting the definition of a circle. This will generally only occur when the undercarriage is stationary.

The above embodiment assumes that the machine does not tram (or travel) and rotate at the same time. This assumption means that the envisioned movement of the machine involves the machine tramming to the desired location, stopping, and then beginning rotation. This assumption, however, is not necessarily practical in actual use. For example, it may be necessary, due to mine topography or other structural limitations, for the machine to tram and rotate prior to reaching the destination. In this case, it is more efficient for the machine to tram and rotate simultaneously en route to the destination.

In the above described embodiment, if a machine trams and rotates at the same time, the system may determine an invalid COR and other information because the system may not be able to understand the movement. For example, the system may typically associate a rotation or swing with a loading event and use this association as a basis for beginning calculations. However, if the machine trams and rotates, for example, independent of a loading event, the system may begin calculations erroneously. Alternatively, if the machine trams and rotates as part of a loading event, the system may fail to begin calculations as it may not associate the rotation with a load event due to the tramming movement. Thus a COR that is calculated after the machine trams and rotates may be inaccurate. The invalid COR may result in erroneous identification of the material in the bucket.

Figure 10:
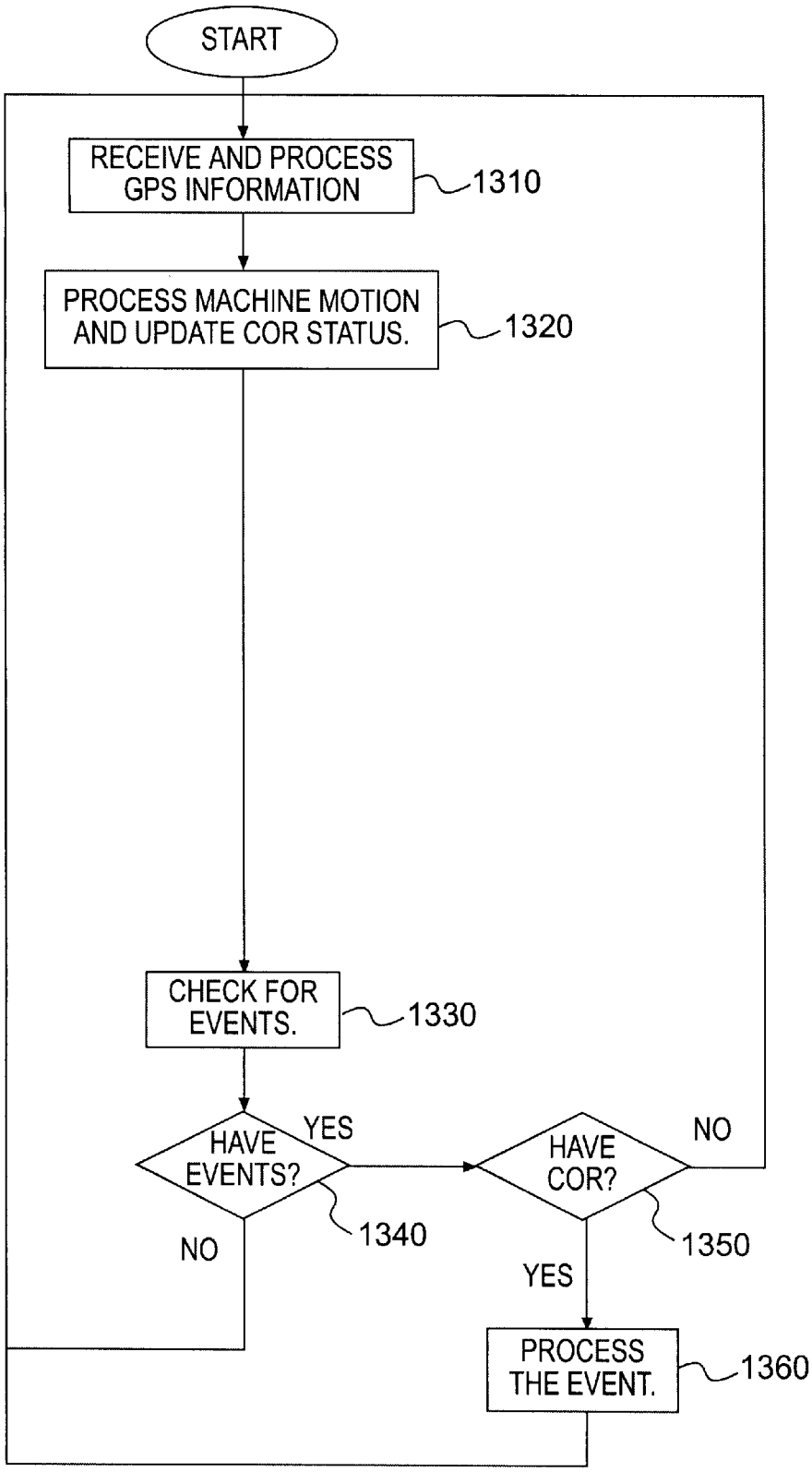
FIG. 10 illustrates a flow chart of an algorithm, consistent with an exemplary embodiment of the present invention.

FIG. 10 illustrates an exemplary method of a second embodiment, consistent with the present invention, that maintains the ability to calculate a COR, and, thus, determine the position and/or orientation of the machine and bucket, even in situations where the machine trams and rotates at the same time.

Typically, the system receives and processes GPS information (step 1310). Based on the GPS information, the system attempts to determine the machine motion, including calculating a COR (step 1320) in a manner similar to a first embodiment. The system may also include status information about the machine's position, orientation, and/or configuration. For example, after receiving GPS information, the system may calculate the COR and related position, orientation, and/or configuration information as described with respect to the first embodiment. The status information may then be updated by storing the newly calculated COR, position, orientation, and/or configuration information. The status information may also include information about the antenna location.

The system then checks for events (step 1330). Events typically include loading and dumping, as it is during these activities that the position and orientation of the machine become important. By checking for an event, the machine may determine if a sensed rotation is due to loading or dumping, and thus, the system should begin calculations to determine position and orientation, or if the sensed rotation is merely due to another movement of the machine, and thus, calculations are not necessary. The system may check for events, for example, by monitoring a machine characteristic that indicates when a loading and/or dumping event has occurred. One exemplary characteristic is hydraulic pressure. The hydraulic pressure within a hydraulic circuit may be monitored to determine when a threshold is exceeded, indicating a load. In another exemplary embodiment, a pressure switch located on the machine may indicate that a load is occurring when a predetermined pressure is sensed by the pressure switch. If no event is sensed (step 1340), the system continues normal operation by receiving and processing GPS information (returning to step 1310). At this point, the system will continually calculate and update the machine's position and orientation, such that even if an erroneous calculation is made due to the simultaneously rotation and tramming, the erroneous calculation will be overwritten by the next calculation and update.

However, if an event is sensed, it is important that the calculations be correct, in order to accurately determine the composition of the material in the bucket. In this case, the system determines if status information has been updated, for example, as part of step 1320 (step 1350). If status information has not been stored, the system has no point of reference and must obtain additional information by continuing to receive and process GPS information (returning to step 1310). Processing the event without updated status information, including for example, the antenna location, COR, position information configuration information, and/or orientation information, may produce inaccurate results because the system may have insufficient data to perform the calculations to obtain the plane of rotation, planes perpendicular, points of intersection, and center of rotation. Inaccurate results in these calculations may lead to an inability to accurately determine the machine and bucket position and orientation. In this case, if it is determined that there is insufficient data due to the lack of updated status information, the received GPS information is disregarded and calculations are not performed.

If the status information has been updated, the event can be processed and calculations can be performed without disregarding the received GPS data (step 1360). By processing the event, the system can differentiate between rotation sensed due to loading and/or dumping versus rotation sensed due to other movements of the machine. As described above, if the rotation is due to loading and/or dumping, it becomes important to accurately begin calculating the position and orientation of the machine. If, however, the rotation is due to some other machine movement, an erroneous calculation may be corrected during subsequent movement. The system may process the event as follows. At the time of the event, the location of the antenna is stored, for example, in a memory associated with computer 818 or 824. Because the system has recognized a loading or dumping event, the system will continue to receive and process GPS information received during the period of swinging or rotation. For example, during the next several swings, GPS information is received and stored in the memory associated with computer 818 or 824. After the second or third swing, the system has sufficient data to calculate the plane of rotation, planes perpendicular, points of intersection, and center of rotation using the equations disclosed in the first embodiment. Once the COR is determined, the system may use information from status information, such as the stored antenna location, in combination with the COR to calculate orientation and position at the time the event occurred. By calculating the orientation and position at the time of loading and/or dumping, it is possible to accurately identify the composition of the loads being excavated.

Figure 11:
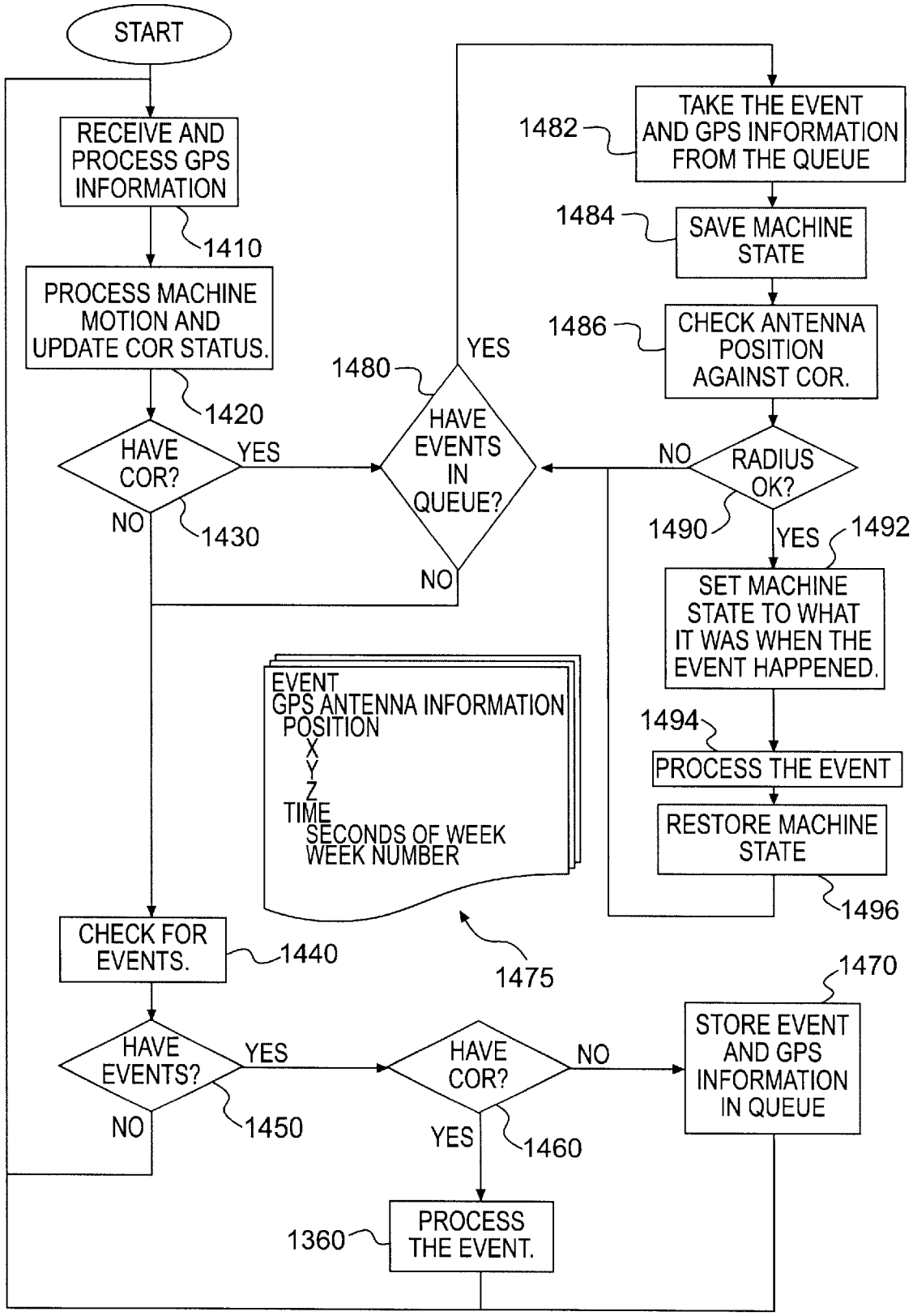
FIG. 11 illustrates a flow chart of an algorithm, consistent with another exemplary embodiment of the present invention.

FIG. 11 illustrates another exemplary method, which may be used in conjunction with the second embodiment of the present invention, that calculates information about the position and/or orientation of a machine during an event, even though the machine may have moved on to another position, orientation, or event. In this embodiment, the system may store indications of events (such as the sensing of the predetermined hydraulic pressure or pressure switch described with respect to the second embodiment) and GPS information surrounding the event, and may perform the calculations at some later point in time. In particular, this method utilizes a queue of events, such that GPS information received in conjunction with the indication of an event can be stored and later used to calculated a COR, position, and orientation associated with that event. In this embodiment, GPS information is received and processed by the system as described above (step 1410). The system may then determine the machine motion and may update status information (step 1420). The system determines if status information has been updated (step 1430). If not, the system checks for events, such as loading and/or dumping (step 1440). If no event has occurred (step 1450), the system continues typical operation by returning to step 1410.

If an event has occurred, however, the system verifies whether or not status information has been updated (step 1460). If updated status information is available, the event is processed as described above, with reference to FIG. 10 (step 1360). If updated status information is not available at the time of an event, the event indication and related GPS information is stored in a queue (step 1470). An exemplary queue entry 1475 may include an indicator of the type of event (loading or dumping), GPS antenna information (including x, y, and z coordinate information), and/or the time at which the event occurred, for example, by the week number and/or the number of seconds.

Returning to step 1430, if the COR and related position, orientation, and/or configuration information (i.e., status information) is determined at this point, the system checks to see if there are events in the events queue (step 1480). If not, the system continues typical operation, returning to step 1440. If there are events in the events queue, the event information and GPS information are obtained from queue entry 1475 (step 1482). Information about the machine's state, including current position, orientation, and configuration information is also stored (step 1484).

The system then compares the antenna position from queue entry 1475 with the determined status information (step 1486). If the antenna position is not within an appropriate radius from the COR location included in the status information, for example, because too much time has elapsed since the occurrence of the event (step 1490), the system cannot process that event and the system returns to step 1480 to determine if there are additional events in the queue. The event cannot be processed if there is too much distance between the antenna position stored during the event and the current location because calculations will be inaccurate, and further, the machine can not be returned to its state (including position, orientation, and/or configuration) at the time of the event. If the antenna position is within an appropriate radius, the machine is returned to its state during the event, based on the information about the machine stored when the event happened in step 1484 (step 1492). Based on the GPS antenna information, status information, and the machine state at the time of the event, the event is processed as described above (step 1494). After the event is processed, the machine state is restored based on the current information (step 1496) and the system then returns to step 1480 to determine if any additional events are in the queue.

Figure 12:
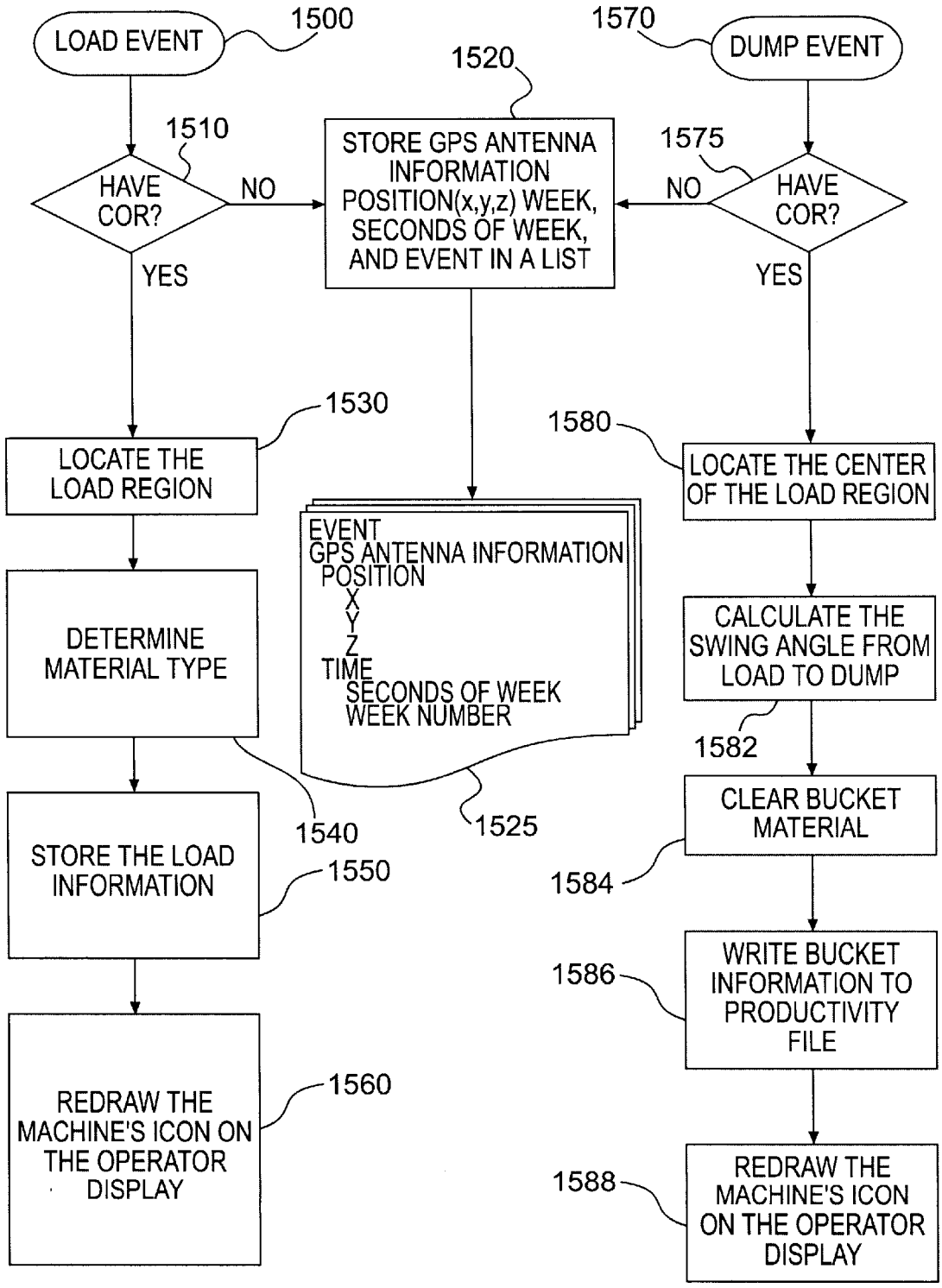
FIG. 12 illustrates a flow chart of an algorithm, consistent with yet another exemplary embodiment of the present invention.

FIG. 12 illustrates a method, which may be used in conjunction with the second embodiment of the present invention, for actions that occur for loading and dumping events, respectively. When an event occurs, this method may be used to accurately determine the composition of the material in the bucket. In the event of loading, a loading event may be sensed by the system (step 1500). This event may be sensed, for example, by monitoring the hydraulic circuit or by using a pressure switch. After the event is sensed, the system determines whether updated status information is available (step 1510). If no status information is available, the event may be stored in an event queue (step 1520). The queue entry 1525 may include the type of event, the GPS antenna information, and/or the time of the event. Events in the event queue may be processed as discussed with reference to FIG. 11.

If status information is available, the system may locate the load region (step 1530). The load region indicates the area from which the load in the bucket was obtained. The load region may be located based on the position of the antenna relative to the site, the position of the COR location relative to the site, the position of the antenna relative to the machine, the position of the load region relative to the machine, and/or the bucket width. After the load region is located, the system determines the material type of the load (step 1540). The material type, for example, may be determined based on a digital material map of the site. The system stores load information, including, for example, the load time, the load angle, the potential, and the load material (step 1550). The operator's display may also be redrawn to display the type of material determined (step 1560). For example, the material may be illustrated in one color indicating ore and another color indicating waste. This display may assist the operator in proceeding to an appropriate dumping site.

Similarly, a dumping event may be sensed, followed by a set of processes. Once a dumping event is sensed by the system (step 1570), the system determines whether status information is available (step 1575). If not, the event is stored in the event queue (step 1520). If status information is available, the center of the load region is determined (step 1580). The center of the load region may be based on, for example, the position of the antenna relative to the site, the position of the machine's COR location relative to the site, the position of the antenna relative to the machine, and/or the position of the load region relative to the machine. The system then calculates the swing angle from the loading region to the dumping region (step 1582). The bucket material is cleared from the system (step 1584), and the bucket information is stored in a productivity file (step 1586). The operator's display may be redrawn to reflect that the bucket material was dumped (step 1588).

Industrial Applicability

In operation, the present invention provides a simple system for determining the location and orientation of the mining shovel and bucket with minimal instrumentation on the shovel. In particular, a single GPS receiver is used to provide all of the relevant shovel and bucket location information. The system also displays the shovel and bucket location in the work site with bench elevation and ore locations also indicated to provide a visual indication of the work to be performed, without the need for stakes, flags, or other surface markers. The operator can, therefore, monitor the bucket location during actual operation relative to any established boundaries, such as ore/waste boundaries and/or property boundaries. Records are also maintained of the material excavated by determining the location of the shovel, including the bucket relative to the material. Advantageously, the GPS antenna is located far enough away from the material being loaded into the bucket and far enough away from any moving shovel parts to avoid damage from normal operations.

Further, the system provides an algorithm for a situation in which the machine both rotates and trams simultaneously. In real-world mining operations, these two activities do at times occur simultaneously, and thus, by improving the system as described above, a greater number of loads can be accurately identified. This leads to improved efficiency and productivity, as waste loads and ore loads are properly identified.

It will be readily apparent to those skilled in this art that various changes and modifications of an obvious nature may be made, and all such changes and modifications are considered to fall within the scope of the appended claims. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A method for determining the location of a work machine at a work site, the work machine including a house, a boom connected to the house, a stick connected to the boom, and a work implement connected to the stick, comprising:

receiving reference signals from an external reference source;

determining the position of a point on the house in response to the received signals;

determining information about the work machine based on a position of the point on the house;

updating a status of a center-of-rotation (COR) information;

determining if an event has occurred; and if an event is determined, reacting to the event, wherein the step of reacting to the event includes:

determining whether an updated COR is available; and if an updated COR is available, processing the event.

2. The method of claim 1, wherein the step of processing the event includes:

storing the position of the point on the house;

storing loading information associated with one or more rotations of the house;

calculating COR information; and determining position information about the work machine based on the stored position of the point on the house and the calculated COR information.

3. The method of claim 2, wherein the step of processing the event further includes:

determining the event is a loading event;

locating the region where the loading event occurred;

determining the material type associated with the load region; and storing information about the load.

4. The method of claim 3, further including communicating the material type to an operator.

5. The method of claim 3, wherein the load information stored includes at least one of a load time, a load angle, and the material type.

6. The method of claim 2, wherein the step of processing the event further includes:

determining the event is a dumping event;

locating the center of a load region;

calculating a swing angle from the load region to a dumping site;

clearing the material type associated with the load; and storing load information.

7. The method of claim 6, further including the step of changing a display on a display screen to reflect a dumping activity.

8. The method of claim 1, wherein the step of determining if an event has occurred includes:

monitoring a hydraulic pressure within the work machine; and determining an event has occurred if the hydraulic pressure exceeds a predetermined value.

9. The method of claim 1, wherein the step of determining if an event has occurred includes:

monitoring a pressure switch within the work machine; and determining an event has occurred if the pressure switch indicates an event.

10. The method of claim 1, further including:

determining if an updated COR is available;

if an updated COR is available, processing events in an events queue; and if an updated COR is unavailable, queuing events in an events queue.

11. The method of claim 10, wherein the step of processing events in the events queue includes:

obtaining event information from the events queue;

obtaining a stored position of the point on the house associated with the event;

storing a current state of the work machine;

comparing the stored position of the point on the house associated with the event and the updated COR; and if the comparison is within a threshold value, performing the steps of:

setting a state of the work machine to a state associated with the event based on the event information;

processing the event based on the event information; and returning the work machine to the stored current state.

12. The method of claim 10, wherein the step of queuing events in the events queue includes:

storing event information associated with the event in the events queue; and storing a position of the point on the house associated with the event in the events queue.

13. The method of claim 12, wherein the event information includes at least one of the type of event, position location information, and the time of the event.

14. An apparatus for determining the location of a work machine at a work site, comprising:

a house;

a boom connected to the house;

a stick connected to the boom;

a work implement connected to the stick;

a positioning system including a receiver connected to the house, the positioning system being configured to determine the location of the receiver in three dimensional space at a plurality of points as the house is rotated and to further determine the location and orientation of the work implement in response to the location of the plurality of points;

a sensor configured to identify an event; and a processor, including a storage device in which a queue of events is stored, configured to determine the location of the receiver in three dimensional space at the time of an event and to process the event in relation to the location of the receiver and the location of the plurality of points.

15. The apparatus of claim 14, further including:

a storage device in which a site survey of the work site is stored; and a display element for indicating the location of the work machine in the work site.

16. The apparatus of claim 14, wherein the sensor determines when the work machine is being loaded.

17. The apparatus of claim 14, wherein the sensor determines when the work machine is being dumped.

18. A method for determining the location of a work machine, having a calculated center of rotation (COR) information, when the work machine trams and rotates simultaneously, the method comprising:

determining when an event has occurred;

storing the calculated COR information upon determining that an event has occurred;

obtaining position information based on received reference signals from an external reference source; and determining a current location of the work machine based on the stored COR information and the obtained position information.

* * * * *